United States Patent [19]

Draper et al.

[11] Patent Number: 4,706,635

[45] Date of Patent: Nov. 17, 1987

[54] FUEL PUMPING APPARATUS

[75] Inventors: Francis R. Draper, Buckhurst Hill; John H. Francis, Cheltenham; Alan P. Ogburn, Cirencester, all of England

[73] Assignee: Lucas Industries public limited company, Birmingham, England

[21] Appl. No.: 760,762

[22] Filed: Jul. 31, 1985

[30] Foreign Application Priority Data

Aug. 10, 1984 [GB] United Kingdom ..... 8420413

[51] Int. Cl.[4] ..... F02M 39/00

[52] U.S. Cl. ..... 123/506; 123/494; 123/458

[58] Field of Search ..... 123/494, 506, 450, 458, 123/357-359; 73/119 A; 417/462

[56] References Cited

U.S. PATENT DOCUMENTS

| | | | |
|---|---|---|---|
| 4,385,867 | 5/1983 | Straubel | 123/509 |
| 4,401,076 | 8/1983 | Saivo | 123/357 |
| 4,428,346 | 1/1984 | Hoshi | 123/458 |
| 4,435,128 | 3/1984 | Frey | 123/509 |
| 4,471,737 | 9/1984 | McDougal | 123/494 |
| 4,531,491 | 7/1985 | Iiyama | 123/450 |
| 4,538,580 | 9/1985 | Straubel | 123/494 |
| 4,546,749 | 10/1985 | Igashira | 123/458 |

*Primary Examiner*—Carl Stuart Miller

[57] ABSTRACT

A fuel pumping apparatus for supplying fuel to an engine includes a pumping plunger reciprocable in a cylinder by a cam having cam lobes. Fuel is displaced during inward movement of the plunger during forward rotation of the engine by the leading flanks of the lobes. A valve can be closed during the inward movement of the plunger to allow fuel flow through an outlet to an engine. The valve is electrically controlled by a control system which receives plunger position signals. These signals are arranged to occur substantially half way along the trailing flanks of the lobes instead of as is more usual at the top dead center positions of the plunger, whereby if the engine is rotating in reverse the valve will be open while the plunger is moved inwardly by the trailing flanks of the lobes.

3 Claims, 3 Drawing Figures

FUEL PUMPING APPARATUS

This invention relates to a fuel pumping apparatus for supplying fuel to an internal combustion engine and comprising a drive shaft adapted to be coupled to a rotary part of an engine to which fuel is to be supplied, a pumping plunger reciprocable within a bore, a cam coupled to the drive shaft and arranged to impart inward pumping movement to the plunger as the shaft rotates, said cam including a cam lobe defining a leading flank and a trailing flank, the leading flank for forward rotation of the engine, imparting inward movement to the plunger, a distributor member coupled to the drive shaft for distributing fuel displaced from the bore to a plurality of outlet ports in turn during successive inward movements of the plunger, means for supplying fuel to the bore, an electrically controlled valve through which fuel can escape from the bore during inward movement of the plunger, electrical circuit means for controlling the operation of said valve, said circuit means being responsive to various engine operating parameters and desired operating parameters so as to control the timing of fuel delivery and the quantity of fuel supplied to the engine and transducer means for supplying signals to the circuit means indicative of the angular position of the drive shaft.

It is known to provide the transducer means in the form of a pair of discs mounted on the shaft with respective transducers. The transducers are responsive to marks or other indicia such as teeth, on the disc whereby as the marks pass the transducers electrical signals will be supplied to the circuit means. One of the discs and its associated transducer is arranged to provide a large number of signals per revolution of the shaft while the other disc and its associated transducer provides a number of signals per revolution of the shaft equal in number to the number of outlets. The signals provided by the said other disc and transducer have been arranged to occur at about the top dead centre positions of the plunger and the circuit means starts to count the signals provided by the one disc and transducer so that the aforesaid valve is closed during the next inward movement of the plunger at the desired instant and for the desired duration. During this time the one end of the bore from which fuel is displaced during inward movement of the plunger, is in communication with an outlet.

This arrangement can be made to work in a satisfactory manner. However, certain safety measures have to be taken. If for some reason the engine rotates in the reverse direction the circuit means will still receive signals and will actuate the valve. However, the valve will be closed when the plunger is being moved inwardly by what is normally the trailing face of the cam. In this situation the one end of the bore may not be in communication with an outlet and a hydraulic lock may occur which could cause damage to the apparatus. Moreover, if the one end of the bore is brought into communication with an outlet, some fuel will be supplied to the engine which would assist the reverse running thereof.

In order to overcome this problem an additional signal is provided by the other disc and transducer which in normal circumstances occurs just after one of the aforesaid signals. If the engine is rotating in the reverse direction the pattern of the intervals between the generation of the signals by the other disc and transducer can be recognized by the circuit means as indicating reverse running and steps can be taken to ensure that the valve is opened to prevent the formation of the hydraulic lock and the supply of fuel to the engine. In order to provide this safety the circuit means has to be more complex.

The object of the present invention is to provide an apparatus of the aforesaid kind in a simple and convenient form.

According to the invention in an apparatus of the kind specified said transducer means includes means for providing plunger position signals substantially midway of the movement of the plunger along the normal trailing flank of the cam lobe whereby if the engine rotation is reversed the valve will be closed after the plunger has reached the crest of the lobe.

An example of an apparatus in accordance with the invention will now be described with reference to the accompanying drawings in which.

Figure 1:
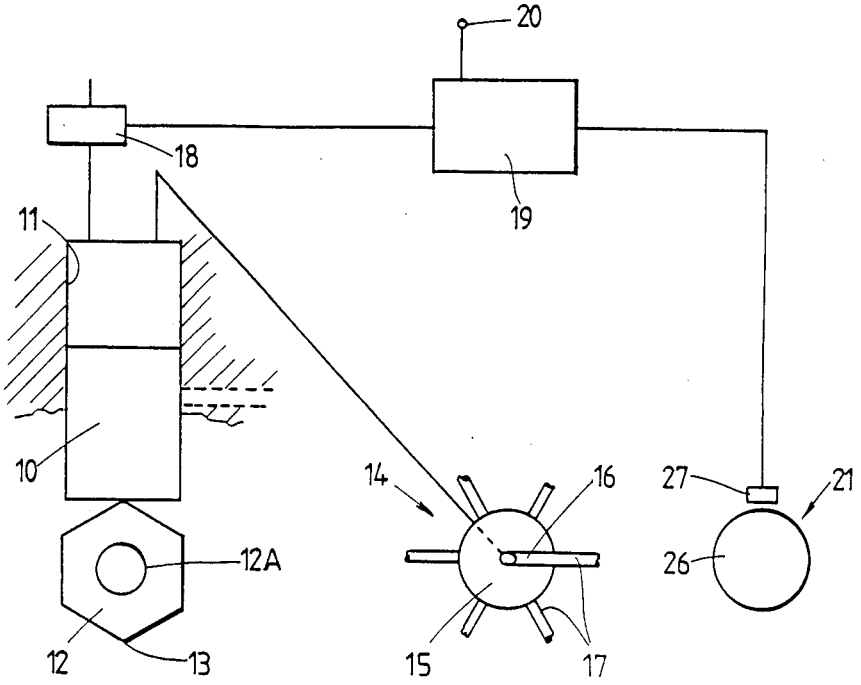
FIG. 1 is a diagrammatic representation of the apparatus.

Referring to FIG. 1 of the drawings the apparatus comprises a plunger 10 which is reciprocable within a bore 11 formed in the housing of the apparatus. Inward movement is imparted to the plunger by means of a rotary cam 12 which is mounted on a drive shaft 12A which in use is connected to a rotary part of the engine. In the particular example the cam is provided with six cam lobes 13 since the apparatus is intended to deliver fuel to a six cylinder engine.

Communicating with the inner or one end of the bore 11 is a distributor arrangement generally indicated at 14 which in the particular example comprises a rotary member 15 coupled to the drive shaft 12A and housed within the surrounding housing of the apparatus. The distributor member is provided with an outwardly extending delivery passage 16 which is connected to the bore 11 and formed in the surrounding portion of the housing is a plurality of outlet ports 17 equal in number to the number of cam lobes, the outlet ports in use being connected to the injection nozzles respectively of the associated engine.

Also communicating with the inner end of the bore 11 is an electrically operated valve 18 which can be energised to prevent escape of fuel from the bore 11 during inward movement of the plunger 10. The valve is controlled by an electrical circuit means 19 which performs the function of governing the associated engine and also ensuring that the valve 18 is closed at the correct time during the cycle of operation and for the required period, to enable delivery of fuel to take place to the associated engine at the correct time and in the correct amount. The circuit means 19 receives at least one desired engine operating parameter signal at an input 20. This signal is a demand signal which may be supplied by a transducer coupled to the throttle pedal of the vehicle driven by the associated engine. In addition, the circuit means receives signals from a transducer means generally indicated at 21 from which signals it can determine the position of the plunger.

Figure 2:
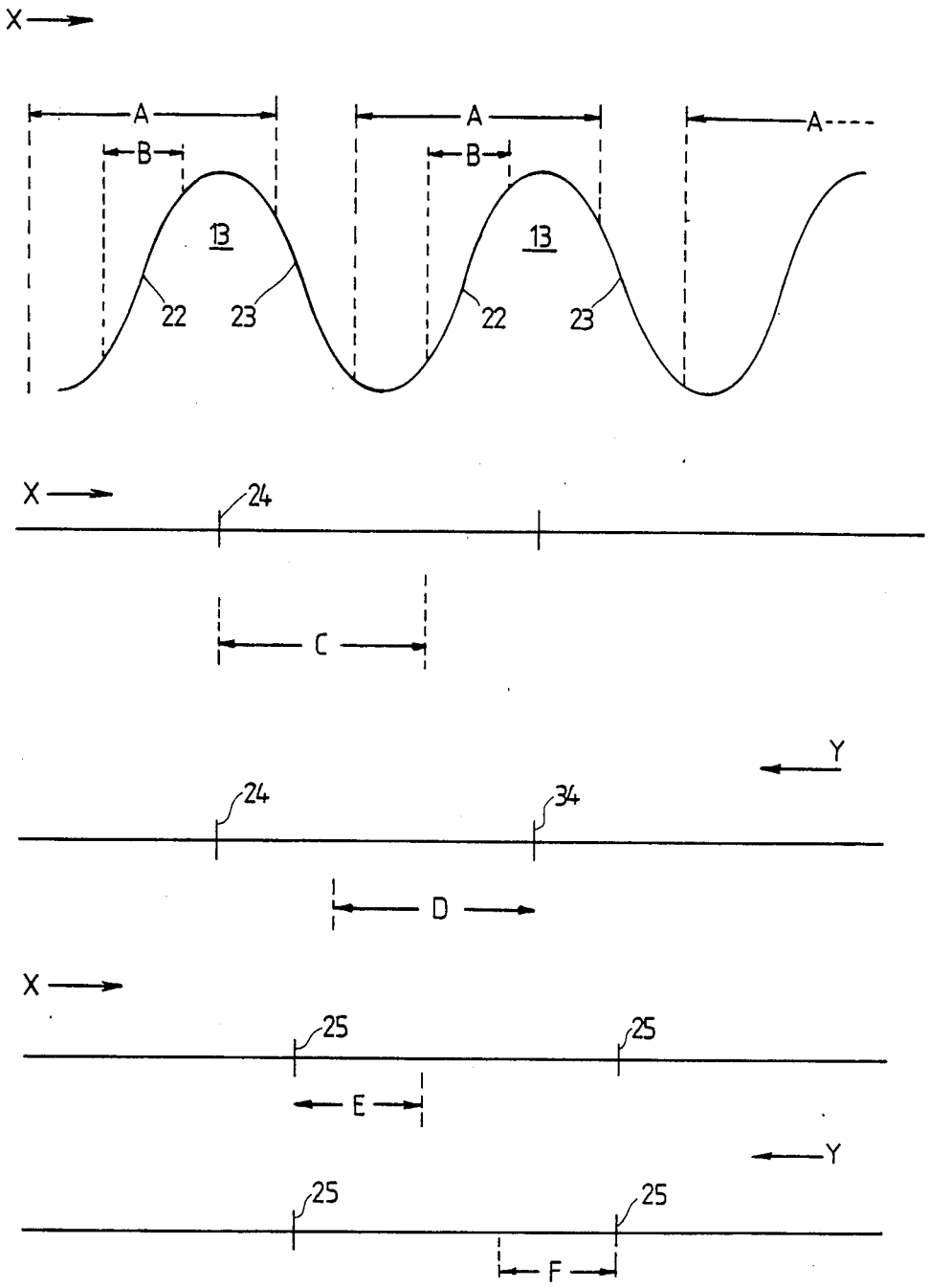
FIG. 2 is a developed view of the cam profile.

Turning now to FIG. 2, there is illustrated a developed view of the cam 12. The arrow X indicates the normal direction of movement of the cam follower which is not illustrated in FIG. 1, so that the faces indicated at 22 are the normal leading faces of the cam lobes and the faces 23 are the normal trailing faces. The intervals referenced A represent the times during which the delivery passage 16 is in communication with an outlet 17 it being appreciated of course that the passage 16 registers with the outlets in turn. The intervals referenced B which occur within the intervals A represent closure of the valve 18 so that during the intervals B with the plunger moving inwardly, and with the valve 18 being closed, fuel will be supplied to an outlet. The intervals A are designed to be substantially longer than the maximum interval B to avoid restriction to fuel flow by part register of the passage 16 with an outlet port 17.

The transducer means 21 in a known arrangement, comprises a pair of discs which are mounted on the drive shaft and which have associated therewith respective transducers. One of the discs has a large number of markings on it which markings might for example be formed by teeth so that the output of the associated transducer will be a series of pulses at regular intervals for example, 3° intervals in the case of a disc having 120 teeth. The other disc is provided with markings such that in the particular example, a signal 24 is provided at the top dead centre position of the plunger. From the two series of signals the circuit means is able to determine the instant at which the valve 18 should be closed to start delivery of fuel to the engine.

From the diagram it will be seen that the instant between a pulse 24 produced by the said other disc and the instant at which the valve 18 is next closed, is represented by the reference letter C. If for some reason reverse rotation of the engine takes place as indicated by the arrow Y in FIG. 2, the signals 24 will still be produced at the same instant but the control system will react to one of the signals 24 and will close the valve at an interval later which is equal to the interval C and is represented in the drawing by the interval D. If the point of closure is projected up to the cam diagram it will be seen that the valve 18 is closed almost as soon as the plunger is moved inwardly by the trailing face 23 of the next cam lobe. It will also be noted that during this inward movement the passage 16 is not in communication with an outlet 17 and hence an hydraulic lock is created which can cause damage to the apparatus owing to the generation of extremely high pressures. In the particular example if the intended period of valve closure (B) is maintained, some fuel would be supplied to the engine before the valve is reopened.

As explained in the opening portion of the specification reverse running has been detected by providing an additional mark on the other disc and by causing the circuit means to recognize the different pattern of intervals obtained when the engine is rotating in reverse.

In accordance with the invention it is proposed that the pulses produced by the so-called other disc are arranged to occur at or about halfway down the normal trailing face 23 of the cam lobe. These pulses are indicated at 25 and the interval between the generation of the pulses 25 and the desired closure of the valve which interval is referenced E, is much shorter. What is more relevant however is that if reverse rotation of the engine takes place the interval F which corresponds to the interval E and at the end of which the valve will be closed, is such that the valve closure occurs when the plunger has passed over the crest of the cam lobe and is moving down the normal leading face 22 of the cam lobe. Thus a hydraulic lock will not be created and fuel will not be supplied to the associated engine, even though the delivery passage 16 will be in communication with an outlet 17.

Figure 3:
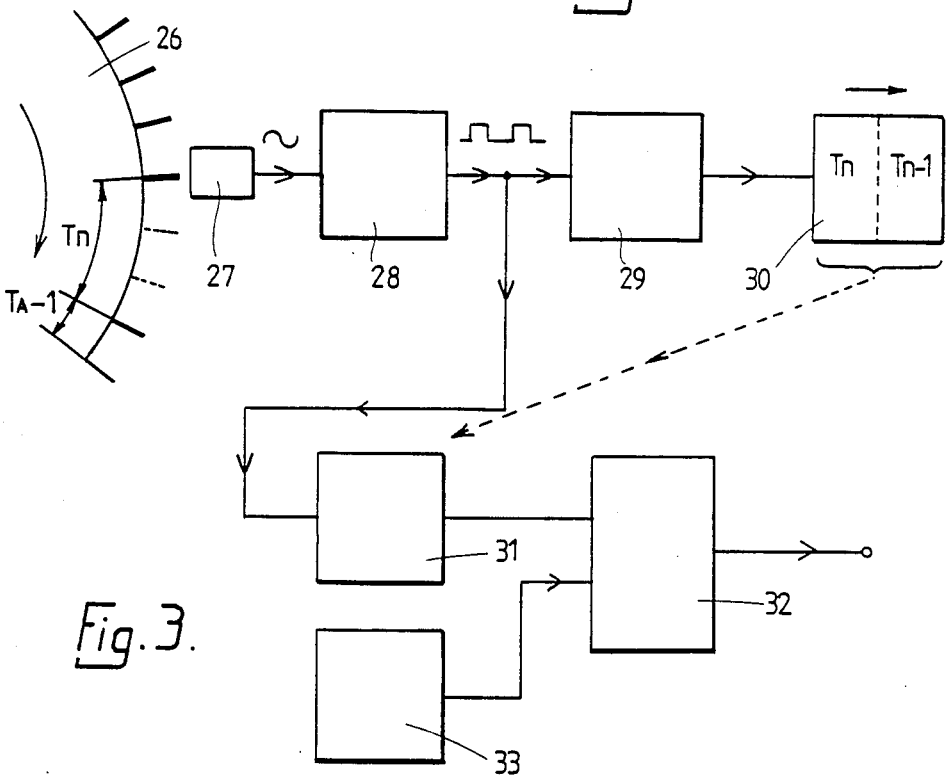
FIG. 3 shows a block diagram of part of an electrical circuit means forming part of the apparatus.

A further simplification shown in FIG. 3 over the known art is to use a single toothed disc and associated transducer instead of the two discs and two transducers previously employed. The transducer means therefore has a single toothed disc 26 and an associated transducer 27 which may be of the magneto resistor type. The disc 26 is provided with a large number of teeth for example, 120 but at equiangularly spaced intervals equal in number to the number of outlets, an equal number of teeth for example 2, are removed. In the example the third and fourth teeth after the top dead centre positions of the disc are removed..

As shown in FIG. 3, the output of the transducer is supplied to a pulse shaping circuit 28 and then to an interval timer 29 which at its output provides a signal $T_n$ representing the time interval between successive shaped pulses produced by the shaping circuit. The successive signals produced by the timer are supplied to a two level stack memory 30 which stores the new time value and the preceding time value.

The pulses from the pulse shaper are also used to initiate operation of a calculation circuit 31 which divides the latest time signal $T_n$ by the previous time signal $T_{n-1}$. The result of the division is compared with a constant value which is larger than unity, in a comparator 32, the constant or reference value being generated by a reference source 33. If the result of the division is greater than the reference value the comparator output will change thus indicating the missing teeth. Conveniently the aforesaid process is carried out by software in a micro computer forming part of the circuit means 19. The signals at the output of the comparator are therefore similar to the signal 25 produced by the aforesaid other disc.

We claim:

1. In a pumping apparartus for supplying fuel to an internal combustion engine and comprising a drive shaft adapted to be coupled to a rotary part of an engine to which fuel is to be supplied, a pumping plunger reciprocable within a bore, a cam coupled to the drive shaft and arranged to impart inward pumping movement to the plunger as the shaft rotates, said cam including a camlobe defining a leading flank and a trailing flank, the leading flank imparting inward movement ot the plunger during forward rotation of the engine, a distributor member coupled to the drive shaft for distributing fuel displaced from the bore to a plurality of outlet ports in turn during successive inward movements of the plunger, means for supplying fuel to the bore, an electrically controlled valve through which fuel can escape from the bore during inward movement of the plunger, the valve being closed to cause delivery of fuel through an outlet, electrical circuit means for controlling the operation of said valve, said circuit means being responsive to various engine operating parameters and desired operating parameters so as to control the timing of fuel delivery and the quantity of fuel supplied to the engine and transducer means for supplying signals to the circuit means indicative of the angular position of the drive shaft, the improvement in combination therewith which comprises: a safety means for detecting reverse engine operation and ensuring that said electrically controlled valve is opened during such reverse operation in a manner which prevents formation of a hydraulic lock and the supplying of fuel to the engine, said safety means including signal generating means mounted on said transducer in a location which provides plunger position signals when the plunger is located substantially midway along the flank of the cam lobe which is the trailing flank when the engine is operating in the forward-running condition and which is the leading flank when the engine is operating in a reverse-running condition, said plunger position signals being adapted to result in said electrically controlled valve closing only after the plunger has passed the crest of the lobe and is moving down the normal leading face of the cam lobe and outwardly during reverse engine operation.

2. An apparatus according to claim 1 in which said transducer means includes a disc coupled to said drive shaft, a plurality of indicia about the periphery of said disc, a transducer responsive to said indicia for producing signals at intervals corresponding to the passing of said indicia past the transducer, one or more of said indicia being omitted over that portion of the disc passing the transducer at the instant when the plunger is substantially midway along the trailing flank of the lobe and signal processing means responsive to the signals provided by the transducer for providing said plunger position signals.

3. An apparatus according to claim 2 in which said signal processing means includes an interval timer for producing output signals representing the time interval between the signals produced by the transducer memory means for storing the instantaneous interval $T_n$ and the preceding interval $T_{n-1}$, and comparing the ratio with a reference, the output of said means being the plunger position signals.

* * * * *